US006006801A

United States Patent [19]

Litwak et al.

[11] Patent Number: 6,006,801

[45] Date of Patent: Dec. 28, 1999

[54] APPARATUS FOR FILLING SANDBAGS AND THE LIKE

[75] Inventors: Deborah Fern Litwak; Steven A. Mailman, both of Dallas, Tex.

[73] Assignee: Litwak Inc., Dallas, Tex.

[21] Appl. No.: 09/126,539

[22] Filed: Jul. 30, 1998

Related U.S. Application Data

[63] Continuation-in-part of application No. 08/889,740, Jul. 10, 1997, abandoned.

[51] Int. Cl.[6] ..... B65B 1/04

[52] U.S. Cl. ..... 141/316; 141/314; 248/95; 248/99

[58] Field of Search ..... 141/234, 237, 141/247, 313, 314, 315, 316, 391; 248/101, 146, 154, 97, 99, 95; 220/512, 513, 495.05, 495.06, 495.09

[56] References Cited

U.S. PATENT DOCUMENTS

| | | | |
|---|---|---|---|
| 928,356 | 7/1909 | Brown | 141/247 |
| 2,447,281 | 8/1948 | Schneir | 141/237 |
| 3,160,306 | 12/1964 | Smalley | 220/512 |
| 3,643,812 | 2/1972 | Mander et al. | 220/512 |
| 4,184,522 | 1/1980 | Waite | 141/231 |
| 4,723,742 | 2/1988 | Krauss | 248/97 |
| 5,215,127 | 6/1993 | Bergeron | 141/10 |
| 5,395,147 | 3/1995 | Brown et al. | 294/55 |
| 5,397,085 | 3/1995 | Spagnolo | 248/97 |
| 5,575,315 | 11/1996 | Wengert | 141/109 |
| 5,597,145 | 1/1997 | Meyers et al. | 248/97 |
| 5,884,878 | 3/1999 | Eckhardt | 248/95 |

*Primary Examiner*—David J. Walczak
*Attorney, Agent, or Firm*—Thompson & Knight L.L.P.

[57] ABSTRACT

An apparatus for filling bags includes a top plate having a plurality of holes therethrough. A plurality of cylindrical bag holders are engaged with each hole of the top plate with an end of each bag holder extending outwardly of the top plate. A stand is connected to the top plate to support the top plate above a supporting surface. A locking plate having a plurality of holes therethrough in registry with the holes of the top plate engages the outwardly extending end of each bag holder to hold a bag in place.

19 Claims, 3 Drawing Sheets

APPARATUS FOR FILLING SANDBAGS AND THE LIKE

CROSS-REFERENCE TO RELATED APPLICATION

The present application is a continuation-in-part of application Ser. No. 08/889,740, filed Jul. 10, 1997, entitled MULTIBAGGER BAGGING MACHINE; now abandoned, which is incorporated herein by reference.

FIELD OF THE INVENTION

The present invention relates to apparatus for filling bags such as sandbags, and more particularly to an apparatus that allows a single individual to fill several sandbags at one time.

DESCRIPTION OF THE PRIOR ART

Historically, the filling of a sandbag has required two persons. One person holds the bag open while the other person shovels sand into the bag. In emergency situations, such as floods, time is usually of the essence, and it is slow and inefficient to fill sandbags in the traditional way.

There have been proposals for sandbag holding devices, which eliminate the need for a person to hold the bag open, thereby freeing that person to fill sandbags himself. Examples of such bag holding devices are disclosed in Meyers, et al., U.S. Pat. No. 5,597,145, and Spagnolo, U.S. Pat. No. 5,397,085. A shortcoming of the bag holding devices of the type disclosed in the '145 patent and the '085 patent is that those devices hold only a single bag. In Krauss, U.S. Pat. No. 4,723,742, there is disclosed a sandbag support that includes spaced apart U-shaped bag holding members that allows two bags to be filled at the same time.

Other examples of sandbag filling devices are disclosed in Wengert, U.S. Pat. No. 5,575,315; Brown, et al., U.S. Pat. No. 5,395,147; Bergeron, U.S. Pat. No. 5,215,127; and Waite, U.S. Pat. No. 4,184,522.

It is an object of the present invention to provide a sandbag filling apparatus that enables a single person to fill multiple bags at the same time. It is a further object of the present invention to provide a sandbag filling apparatus that may be easily and efficiently transported to and assembled at a sandbag filling site.

SUMMARY OF THE INVENTION

Briefly stated, the present invention provides an apparatus for filling bags. The apparatus includes a top plate having a plurality of holes therethrough. A plurality of cylindrical bag holders are engaged with each hole of the top plate, there being one bag holder for each hole of the top plate. An end of each bag holder extends outwardly of the top plate. A stand is connected to the top plate to support the top plate above a supporting surface. The apparatus of the present invention includes a locking plate having a plurality of holes therethrough in registry with the holes of the top plate. The holes of the locking plate are engageable with the outwardly extending end of each bag holder to hold a bag in place.

Preferably, the stand includes a pair of first stand plates spaced apart from and substantially parallel to each other. The first stand plates are each affixed substantially perpendicular to the top plate. The stand also includes a pair of second stand plates spaced apart from and substantially parallel to each other and substantially orthogonal to the first stand plates. The second stand plates are affixed substantially perpendicular to the top plate. Each of the first stand plates includes a pair of spaced apart substantially parallel slits extending inwardly from an edge of each first stand plate. Similarly each of the second stand plates includes a pair of spaced apart substantially parallel slits extending inwardly from an edge of each second stand plate. Each slit of the second stand plate engages a slit of the first stand plate.

DESCRIPTION OF THE PREFERRED EMBODIMENT

Figure 1:
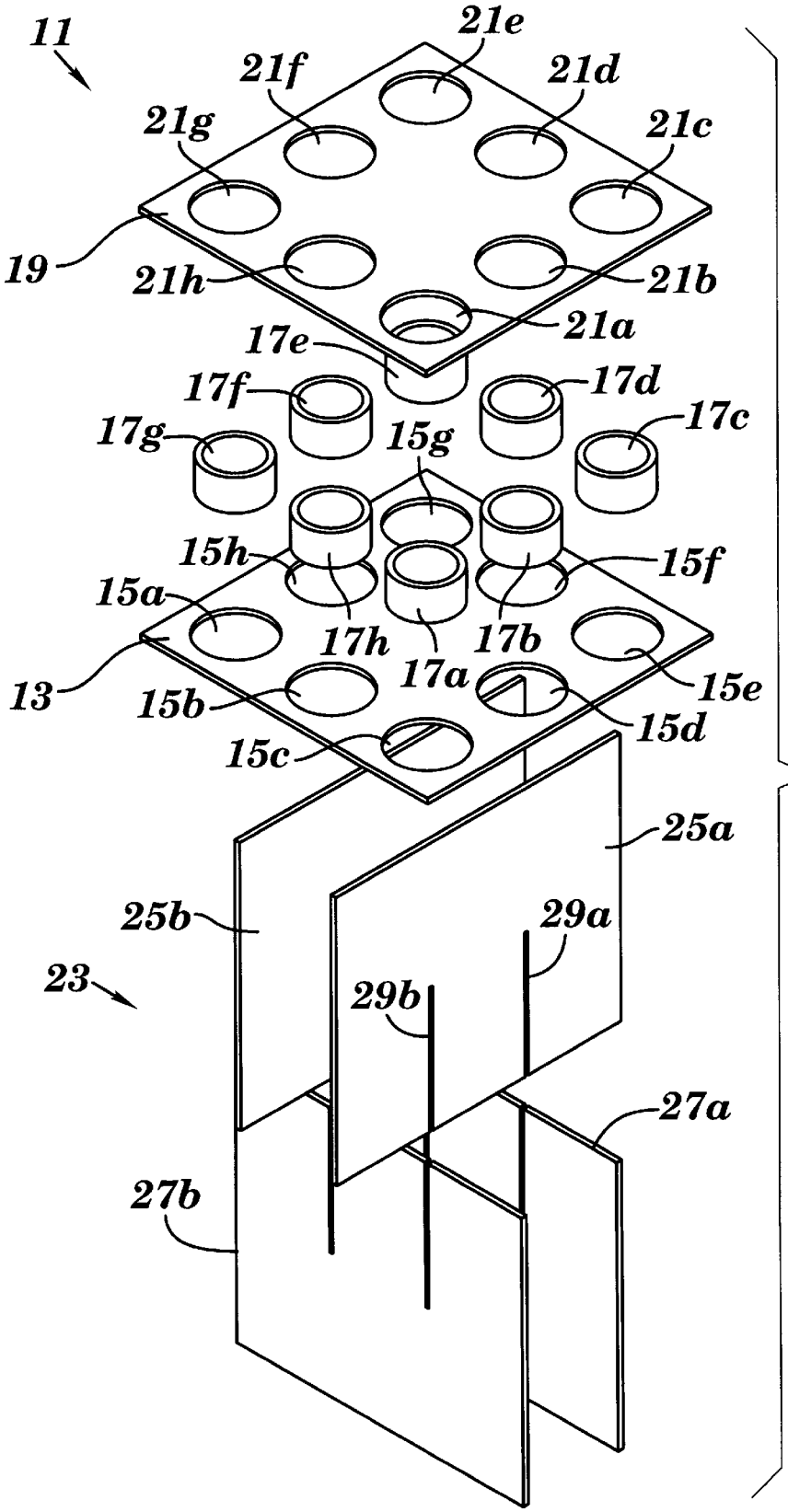
FIG. 1 is an exploded view of the apparatus of the present invention.

Referring now to the drawings, and first to FIG. 1, an apparatus for filling sandbags according to the present invention is designated generally by the numeral 11. Apparatus 11 includes a top plate 13, which is preferably of a rigid material such as plywood or the like. Top plate 13 may be covered with a plastic laminate to make it more durable.

Top plate 13 has formed therein a plurality of holes 15 (15*a*–15*h*). In the preferred embodiment, holes 15 are spaced substantially equally apart three-on-a-side along the edges of top plate 13. In the preferred embodiment, there is no hole in the middle of top plate 13. Holes 15 are adapted to receive a plurality of cylindrical bag holders 17 (17*a*–17*h*). Bag holders 17 are preferably of circular cross section and are sized to fit closely within holes 15. In the preferred embodiment, bag holders 17 are lengths of plastic pipe. As will be explained in detail hereinafter, an end of each bag holder 17 extends outwardly from top plate 13 to provide a rim over which the open end of a bag may be folded.

Apparatus 11 includes a locking plate 19. Locking plate 19 is made of a flat rigid material such as plywood or the like and it is of substantially the same size as top plate 13. Locking plate 19 may be covered with a plastic laminate or the like.

Locking plate 19 has a plurality of holes 21 (21*a*–21*h*) formed therein. Holes 21 are formed to register with holes 15 of top plate 13. Holes 21 have a diameter somewhat larger than bag holders 17 so that they may be slipped over bag holders 17 to hold bags in place during filling.

Apparatus 11 includes a stand, designated generally by the numeral 23. Stand 23 includes a pair of first stand plates 25 and a pair of second stand plates 27. Each stand plate 25 and 27 includes a pair of slots 29. Slots 29 of each stand plate are spaced apart a distance somewhat greater than the diameter of a hole 15 of top plate 13. Slots 29 extend from an edge of a stand plate about to the center line of the stand plate. Slots 29 of first stand plates 25 are adapted to engage corresponding slots 29 of second stand plate 27 to form a substantially rigid stand 23. When stand 23 is assembled, stand 23 is adapted to support top plate 13 above a surface, such as the ground.

Preferably, apparatus 11 is shipped in kit form for assembly at the sandbag filling site. Preferably, plates 13, 19, 25, and 27 are stacked flat and they may be strapped or banded together for shipment. Cylindrical bag holders 17 may be placed in a bag or the like for shipment with the plates. A suitable adhesive or adhesive tape (neither shown) is preferably shipped with the parts so that the bag holders 17 may be affixed within the holes 15 and so that stand 23 may be affixed to top plate 13.

Figure 2:
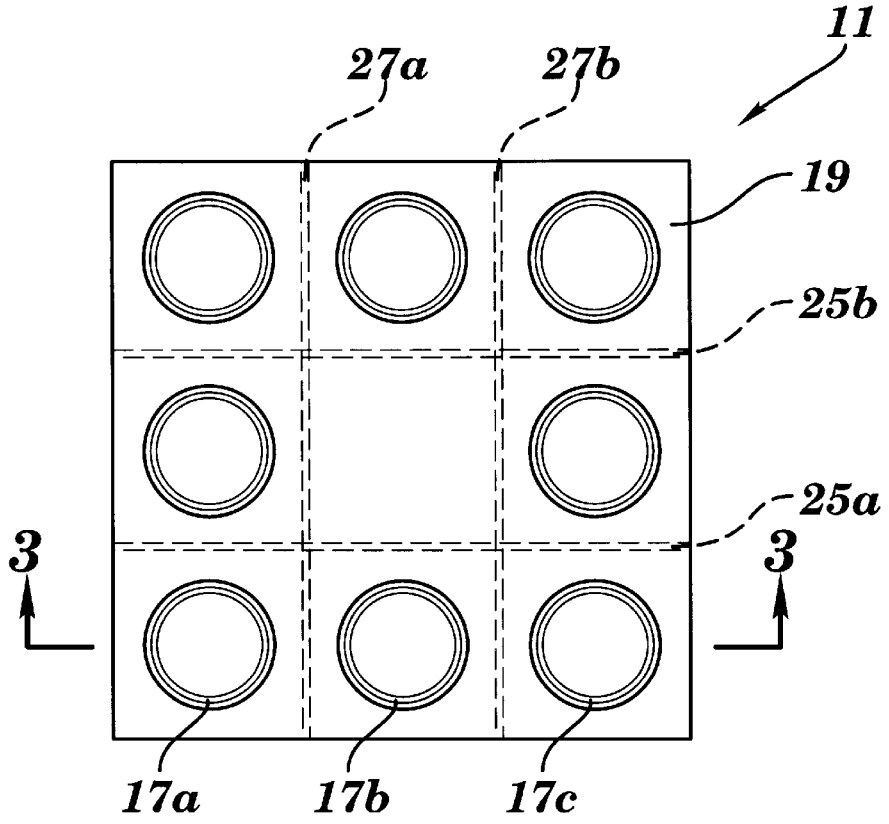
FIG. 2 is a top view of the apparatus of the present invention.
Figure 3:
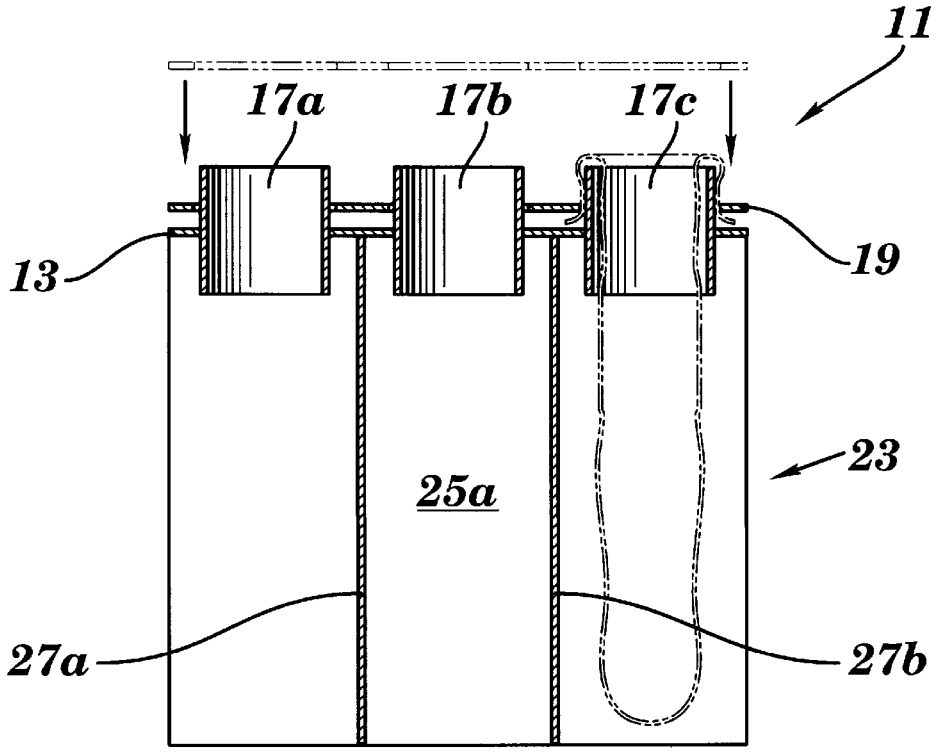
FIG. 3 is a side sectional view taken along line 3—3 of FIG. 2 of the apparatus of the present invention.
Figure 4:
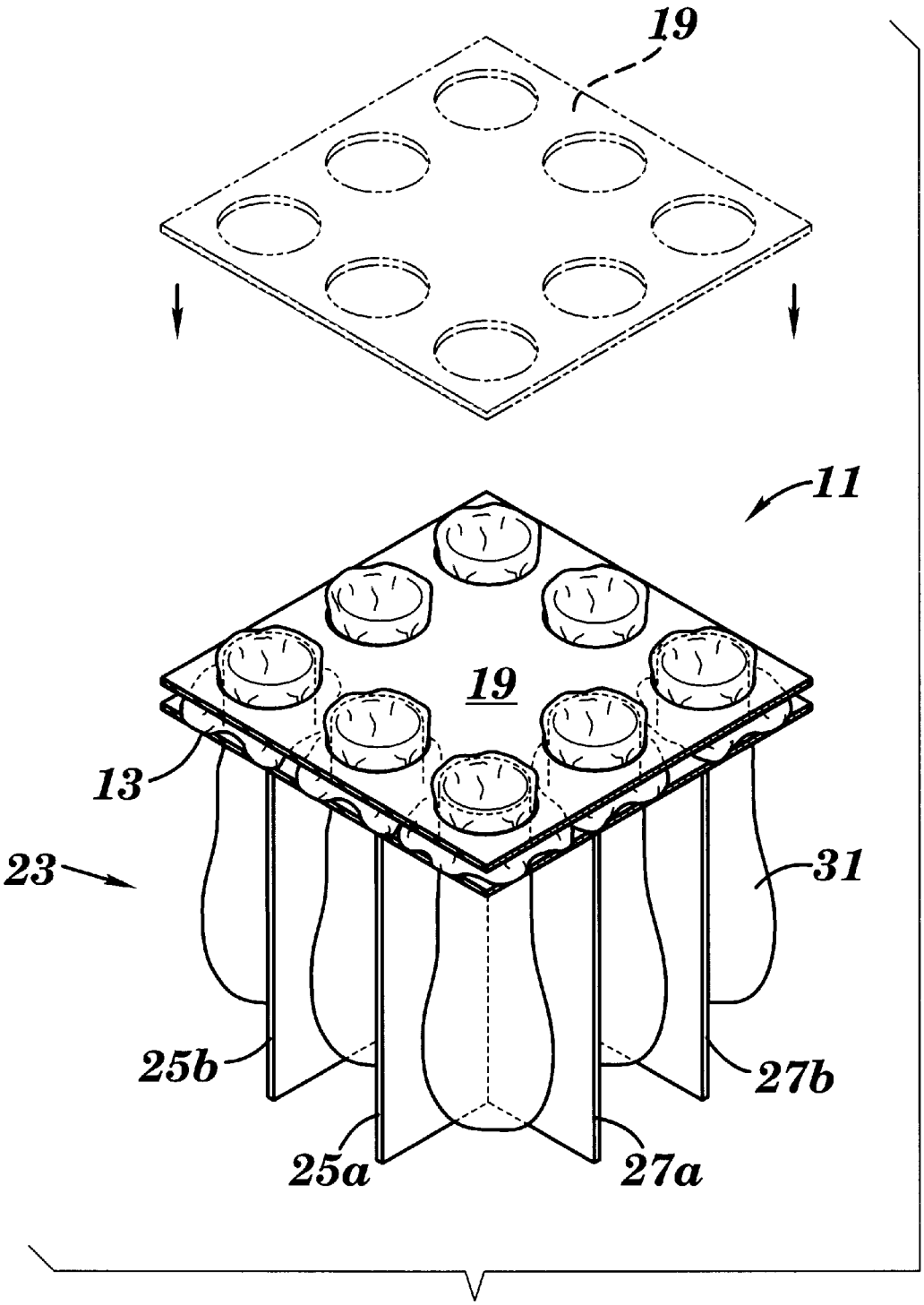
FIG. 4 is a perspective view of the apparatus of the present invention.

Referring now to FIGS. 2–4, there are shown various views of apparatus 11 in its assembled form. In operation, locking plate 19 is separated from bag holders 17 and top plate 13, as shown in phantom in FIG. 4. The closed end of a bag 31 is inserted into each bag holder 17. The open end of each bag 31 is folded over and around its bag holder 17 to lay out on the surface of top plate 13. Then, locking plate 19 is placed over bag holders 17 to lock the bags 31 in place. The bags 31 may then be filled with sand or other fluent material with a shovel or the like. When the bags are filled, locking plate 19 is removed thereby freeing the open ends of bags 31. The filled bags 31 are then removed from apparatus 11. As best shown in FIG. 4, plates 25 and 27 of stand 23 define outwardly facing, open-sided, sleeves through which filled bags 31 may be removed.

From the foregoing, it may be seen that the present invention provides an efficient and easily transportable apparatus with which a single person can fill multiple bags. The plates of the apparatus of the present invention may be shipped unassembled to a bag filling site. The unassembled plates may be assembled quickly and easily into the completed device. Once assembled, an individual can fill several bags at one time.

Although the present invention has been illustrated and described with reference to a preferred embodiment, those skilled in the art will recognize alternative embodiments, given the benefit of this disclosure. Also, while the present invention is preferably used in the filling of sandbags, those skilled in the art will recognize that the present invention may be used in the bagging of grain, seeds, or any other fluent material.

What is claimed is:

1. Apparatus for filling bags, which comprises:

a top plate, said top plate having a plurality of holes therethrough;

a plurality of cylindrical bag holders, there being one bag holder engaged with each hole of said top plate, an end of each bag holder extending outwardly of said top plate;

a stand connected to said top plate; and, a locking plate, said locking plate having a plurality of holes therethrough in registry with said holes of said top plate, said holes of said locking plate being engageable with the outwardly extending end of each said bag holder.

2. The apparatus as claimed in claim 1, wherein said stand comprises:

a pair of first stand plates spaced apart from and substantially parallel to each other, said first stand plates being affixed substantially perpendicular to said top plate; and, a pair of second stand plates spaced apart from and substantially parallel to each other and substantially orthogonal to said first stand plates, said second stand plates being affixed substantially perpendicular to said top plate.

3. The apparatus as claimed in claim 2, wherein:

each of said first stand plates includes a pair of spaced apart substantially parallel slits extending inwardly from an edge of each said first stand plate; and, each of said second stand plates includes a pair of spaced apart substantially parallel slits extending inwardly from an edge of each said second stand plate, each slit of said second stand plate engaging a slit of said first stand plate.

4. The apparatus as claimed in claim 3, wherein each hole in said top plate is aligned with a bag sleeve.

5. The apparatus as claimed in claim 2, wherein said first and second stand plates engage each other to define eight outwardly facing bag sleeves, each of said bag sleeves having at least one open side.

6. The apparatus as claimed in claim 1, wherein said bag holders are affixed to said holes of said top plate.

7. The apparatus as claimed in claim 1, wherein said stand comprises:

a first stand plate affixed substantially perpendicular to said top plate; and, a second stand plate substantially orthogonal to said first stand plate and affixed substantially perpendicular to said top plate.

8. The apparatus as claimed in claim 7, wherein:

said first stand plate includes a slit extending inwardly from an edge said first stand plate; and, said second stand plate includes a slit extending inwardly from an edge of said second stand plate, said slit of said second stand plate engaging said slit of said first stand plate.

9. The apparatus as claimed in claim 7, wherein said first and second stand plates engage each other to define outwardly facing bag sleeves, each of said bag sleeves having at least one open side.

10. The apparatus as claimed in claim 9, wherein each hole in said top plate is aligned with a bag sleeve.

11. Apparatus for filling bags, which comprises:

a top plate, said top plate having a plurality of holes therethrough;

a plurality of cylindrical bag holders, there being one bag holder engaged with each hole of said top plate, an end of each bag holder extending outwardly of said top plate;

a locking plate, said locking plate having a plurality of holes therethrough in registry with said hole of said top plate, said holes of said locking plate being engageable with the outwardly extending end of each said bag holder;

a pair of first stand plates spaced apart from and substantially parallel to each other, said first stand plates being affixed substantially perpendicular to said top plate; and, a pair of second stand plates spaced apart from and substantially parallel to each other and substantially orthogonal to said first stand plates, said second stand plates being affixed substantially perpendicular to said top plate.

12. The apparatus as claimed in claim 11, wherein:

each of said first stand plates includes a pair of spaced apart substantially parallel slits extending inwardly from an edge of each said first stand plate; and, each of said second stand plates includes a pair of spaced apart substantially parallel slits extending inwardly from an edge of each said second stand plate, each slit of said second stand plate engaging a slit of said first stand plate.

13. The apparatus as claimed in claim 11, wherein said first and second stand plates engage each other to define eight outwardly facing bag sleeves, each of said bag sleeves having at least one open side.

14. The apparatus as claimed in claim 13, wherein each hole in said top plate is aligned with a bag sleeve.

15. The apparatus as claimed in claim 11, wherein said bag holders are affixed to said holes of said top plate.

16. Apparatus for filling bags, which comprises:

a top plate, said top plate having a plurality of holes therethrough;

a plurality of cylindrical bag holders, there being one bag holder for each hole of said top plate, said bag holder being adapted to engage with each hole of said top plate with an end of each bag holder extending outwardly of said top plate;

a locking plate, said locking plate having a plurality of holes therethrough in registry with said hole of said top plate, said holes of said locking plate being engageable with the outwardly extending end of each said bag holder;

a pair of first stand plates, said first stand plates being adapted to be affixed substantially perpendicular to said top plate spaced apart from and substantially parallel to each other; and, a pair of second stand plates, said second stand plates being adapted to be affixed substantially perpendicular to said top plate spaced apart from and substantially parallel to each other and substantially orthogonal to said first stand plates.

17. The apparatus as claimed in claim 16, wherein:

each of said first stand plates includes a pair of spaced apart substantially parallel slits extending inwardly from an edge of each said first stand plate; and, each of said second stand plates includes a pair of spaced apart substantially parallel slits extending inwardly from an edge of each said second stand plate, each slit of said second stand plate being engageable with a slit of said first stand plate.

18. The apparatus as claimed in claim 16, including means for affixing said bag holders within said holes of said top plate.

19. The apparatus as claimed in claim 16, including:

means for affixing said pair of first stand plates substantially perpendicular to said top plate spaced apart from and substantially parallel to each other; and, means for affixing said pair of second stand plates substantially perpendicular to said top plate spaced apart from and substantially parallel to each other and substantially orthogonal to said first stand plates.

* * * * *